US005641081A

United States Patent [19]

Merl

[11] Patent Number: 5,641,081

[45] Date of Patent: Jun. 24, 1997

[54] PRODUCT DISPLAY SYSTEM

[76] Inventor: Milton J. Merl, 50 Wilcox Rd., Stonington, Conn. 06830

[21] Appl. No.: 311,864

[22] Filed: Sep. 26, 1994

Related U.S. Application Data

[63] Continuation-in-part of Ser. No. 248,759, May 25, 1994, Pat. No. 5,472,103.

[51] Int. Cl.[6] ..... A47H 1/00

[52] U.S. Cl. ..... 211/103; 211/106

[58] Field of Search ..... 211/87, 88, 103, 211/106, 181, 193, 207, 94.5

[56] References Cited

U.S. PATENT DOCUMENTS

| | | | |
|---|---|---|---|
| 754,503 | 3/1904 | Rubicom et al. | 211/87 |
| 2,068,028 | 1/1937 | Jernson | 211/106 X |
| 2,560,896 | 7/1951 | Rubenstein | 211/106 |
| 2,743,020 | 4/1956 | Rubenstein | 211/106 X |
| 3,595,404 | 7/1971 | Goldstein | 211/106 X |
| 4,248,352 | 2/1981 | White | 211/106 X |
| 4,634,010 | 1/1987 | Otema | 211/103 X |
| 4,694,966 | 9/1987 | Sorenson et al. | 211/88 |
| 5,305,898 | 4/1994 | Merl | 211/103 X |
| 5,425,461 | 6/1995 | Larson | 211/88 |

*Primary Examiner*—Korie Chan
*Attorney, Agent, or Firm*—Schweitzer Cornman & Gross

[57] ABSTRACT

A product display system comprises a bracket particularly adapted to support and display multi-pack products is mounted to vertical uprights. In a first embodiment the bracket supports the multi-pack products both at the bottom of the multi-pack as well as along the bottom surface of a common top cover. In a second embodiment, particularly adapted for the support of multi-pack products in an overwrap, the bracket supports the product at the bottom and has upstanding sides for lateral product support. The support elements are preferably formed from wire stock.

8 Claims, 5 Drawing Sheets

PRODUCT DISPLAY SYSTEM

The present invention relates to merchandising systems and more particularly to an improved bracket for use in conjunction with currently available merchandising displays. The present application is a continuation-in-part of application Ser. No. 08/248,759, filed May 25, 1994, now U.S. Pat. No. 5,472,103.

SUMMARY OF THE INVENTION

The majority of inventory in retail stores is carried in a form of construction utilizing gondolas or trays for the products. Such format has changed little over the years. A floor platform supports a vertical upright backing board which defines the gondola. The gondola includes vertical weight-supporting uprights having a plurality of vertical slots. The uprights and slots are adapted to support shelving and other elements in or on which merchandise is placed for display. While such gondolas are typically employed for the display of goods directly on the selling floor, similar structures are employed in freezer cases and the like for the display and storage of refrigerated goods.

The gondolas are required to display and support an ever increasing variety of products in a staggering assortment of packaging. For efficient space utilization, each product is often displayed in a gondola at an assigned location, not intermixed with other products or even the same product in a different size or packaging. The current gondola merchandising system is ill-equipped to handle such variety. There is typically not enough gondola space available to keep and display all the products, and the shelving generally employed is ill-adapted to accommodate and efficiently display the variety of packaging in which the products are presented.

Modern merchandising embraces the intermixing of products in an attempt to obtain greater product density. Conventional gondola displays are often unable to accommodate such a requirement.

In co-pending application Ser. No. 248,759, a segmented shelving construction was disclosed which has the versatility to accommodate packaging of various shapes and configurations.

In co-pending application Ser. No. 259,464 a bracket construction was disclosed for support of tub-packaged products. Such bracket allowed individual rows of product to be supported and displayed, thus allowing the goals of modern merchandising to be accomplished in connection with the display of such products.

The present invention is directed to the similar presentation of products packaged for sale in "multi pack" formats, in which, in an illustrative format, individual container units are joined to each other in an array form by use of a common top panel, which typically forms the covers for the containers. The top panel is perforated or scored to allow the individual containers to be separated by the consumer for use. Because the top panel is of a thin, flexible construction, such packaging does not have the rigidity and stability of unitary packaging. In an alterative arrangement, the undivided container units are further enclosed in an outer wrapper. Other packaging, in which individual cup-like containers are joined together into an array by an outer wrap, also constitute a multi-pack structure to which the present invention is addressed.

OBJECTS AND ADVANTAGES OF THE PRESENT INVENTION

It is accordingly an object of the present invention to develop an improved display system which can be utilized for supporting packaging of the multi-pack style, and in particular which can be utilized in connection with the segmented shelving construction of application Ser. No. 248,759 which has the capability of accommodating packaging of various shapes and layouts.

Yet another object of the present invention is to provide a display system in which a greater product density for multi-pack packaged product for a given amount of volume may be achieved.

Yet a further object of the present invention is to provide a display system which incorporates a bracket which allows multipack products to be stacked and maintained in an efficient manner.

Still another purpose of the present invention is to provide a bracket for multi-pack products which may be easily utilized in conjunction with conventional gondola constructions and which provides flexibility in layout.

A further purpose of the present invention is to provide such a bracket construction in a manner which is economical to construct and of simplified use.

BRIEF DESCRIPTION OF THE INVENTION

The present invention consists of a master support assembly having a pair of horizontally-extending hanging bar units which engage with existing gondola-type structures through an interface utilizing the slots of conventional gondola standards which are normally used to support existing shelving. Each of the hanging bar units includes a horizontal hanger bar which is constructed to mate with spaced hanger brackets. The hanger brackets are mountable upon the vertical standards of the gondola structure and thus support the hanging bar from the gondola standards. The hanger brackets are slidable along the length of the hanging bars, which allow a hanging bar to be utilized in connection with gondola standards of varying spacing.

The hanging bars are typically mounted in pairs on the gondola standards, and support pairs of vertical bars, which are provided with spaced pairs of slots to which product support brackets are mounted. In a first preferred embodiment, the support bracket, which is particularly adapted to support multi-pack products joined by a common top panel, includes a first horizontal U-shaped wire member to support the bottom of the individual containers which form the multi-pack. A second pair of parallel wires, positioned above the U-shaped member, support the bottom surface of the top panel of the multi-pack, and are positioned to fit between the sides of adjacent individual container units. The forward portions of the upper parallel wires may be joined in a hook-like arrangement, providing a forwardly-projecting support for a product-identifying marker or flag.

In a second embodiment particularly adapted for the support and display of overwrapped products, the support bracket comprises a pair of horizontal U-shaped wire members to support the bottom of the wrapped array. A peripheral wire extends transversely across the bracket at the front end, supporting the horizontal U-shaped wires, and extends rearwardly and upwardly from the front corners of the bracket opposed sides.

In both embodiments, the rear portions of the formed wire members are joined to a rear mounting bracket which includes a clip assembly for engagement with a chosen slot pair in the vertical bars. The support bracket can thus be easily positioned as desired in a vertical plane, allowing similar and other brackets to be combined as desired to obtain a mix of products having varying packaging across the width and height of the gondola.

For a more complete understanding of the above and other features and advantages of the present invention, reference should be made to the following detailed description of a preferred, but nonetheless illustrative embodiment of the invention and the accompanying drawings.

DETAILED DESCRIPTION OF THE INVENTION

Figure 2:
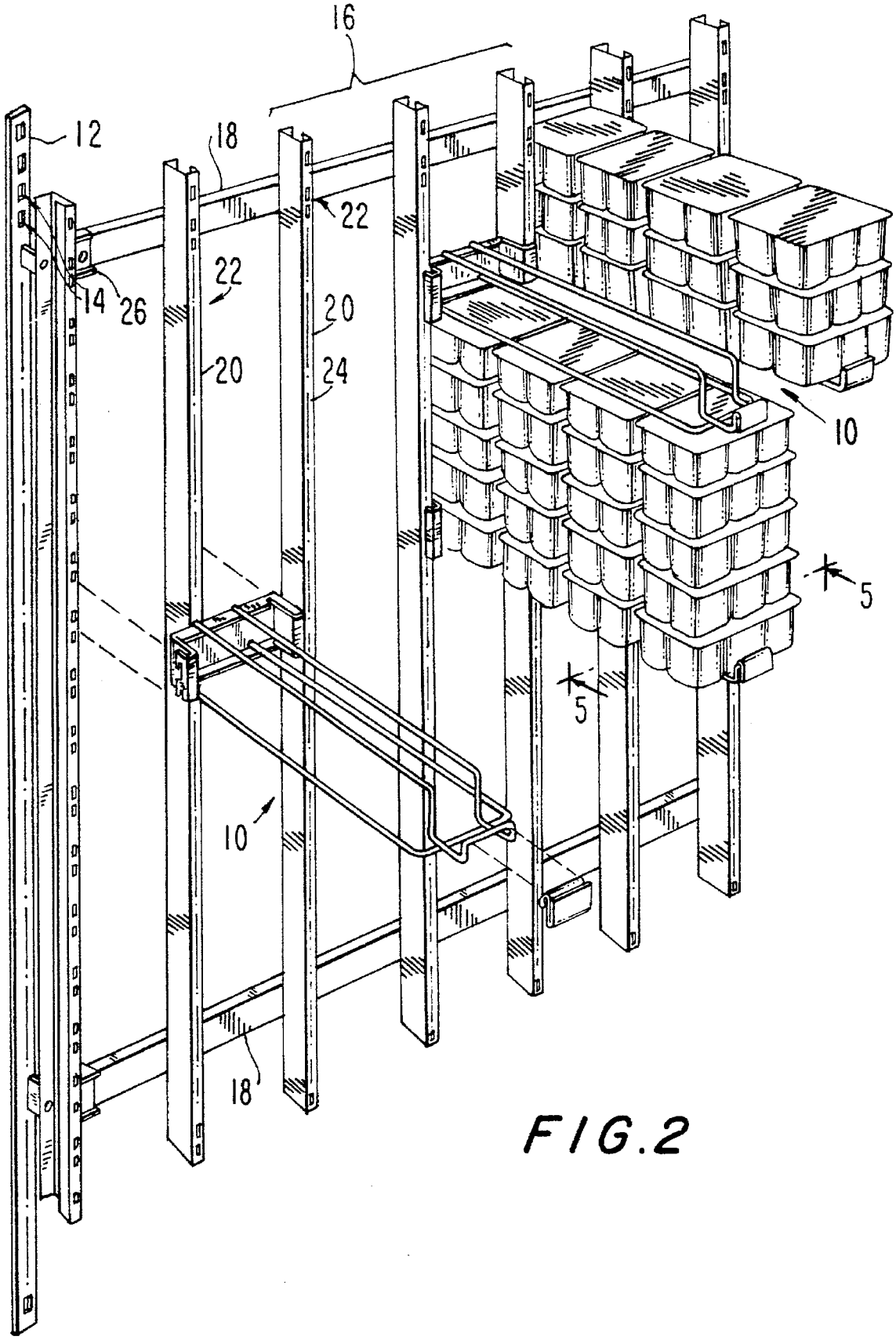
FIG. 2 is a front, exploded, perspective view of the construction further depicting product placed thereon.

Referring initially to FIG. 2, the present invention comprises a product display and storage bracket unit 10 intended to be mounted through a support interface system onto a pair of vertical uprights or standards 12 which may form portions of conventional retailer gondola and freezer unit shelving supports. Each of the vertical standards 12 is provided with a plurality of vertical slots 14 defined therein. In normal usage, horizontal shelves are secured via hooks upon the slots and are supported in a cantilever fashion from the standards 12. The bracket unit 10 of the present invention, which is adapted to support multi-pack products interface with the vertical uprights through a support system 16 which includes a pair of horizontal hanger bars 18, each of which is removably mounted to the vertical uprights 12, which hanger bars in turn support pairs of vertical bars 20 to which the bracket units 10 are affixed. The vertical bars 20 are provided with a plurality of slot pairs 22 along the bars' outwardly-directed front face 24, thus allowing a plurality of bracket units 10 to be positioned as desired along the length of the bars.

Figure 1:
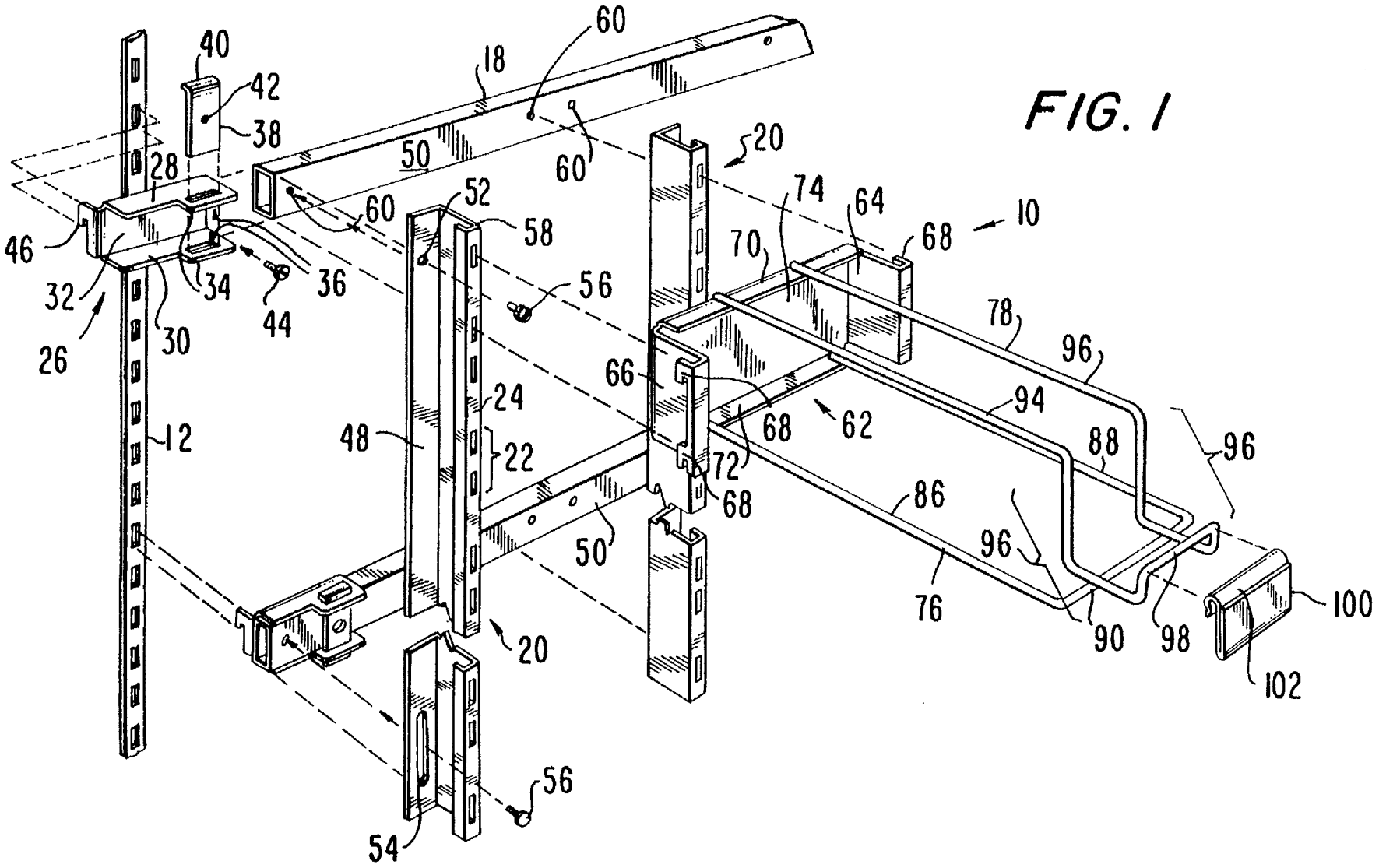
FIG. 1 is a front, exploded, perspective view of the construction of the present invention.

As detailed in FIG. 1, the horizontal hanger bars 18 may be preferably formed of rectangular tube stock, and are mounted to the vertical uprights 12 by use of mounting clips 26. Each of the clips 26 includes a pair of top and bottom walls 28, 30, respectively which, in combination with back wall 32 from which they project, define a three-sided channel through which the horizontal hanger bar 18 may extend. A first end of each of the top and bottom walls is provided with a tab-like portion 34, which extends outwardly beyond the inserted horizontal bar 18, and which are provided with aligned slots 36 through which locking member 38 may be inserted. The upper end of the locking member 38 may be provided with a right angle bend defining a tab 40 to prevent the locking member from falling through the slots. In addition, contact between the tab and the clip top wall 28 defines an inserted position for the locking member, whereby locking member threaded throughbore 42 is generally centered between the top and bottom walls of the clip, allowing a small bolt 44 to be threaded therethrough, engaging the front face of the inserted hanger bar 18 to lock the hanger bar in place.

The second end of the bottom wall of the mounting clip 26 is provided with a rearwardly-extending hook member 46, adapted to engage a slot on the vertical upright 12, allowing the mounting clip to be vertically positioned upon the upright as desired. Because of the adjustable fit between the hanger bar 18 and the mounting clip 26, the hanger bars may be mounted to vertical uprights 12 having a variety of spacings. The front face of horizontal hanger bar 18 is provided with threaded bores 60 which are appropriately spaced to allow the vertical bars 20 to be mounted with appropriate spacing for the bracket units 10, as will be discussed infra.

The vertical bars 20, to which the bracket units 10 are mounted, may be preferably of a generally L-shape construction in cross section, with a base portion 48 abutting the front faces 50 of the hanger bars 18. The base portion 48 may be provided with a throughbore 52 proximate its upper end and a slot 54 proximate its lower end through which mounting screws 56 project to mount the vertical bars to the hanger bars 18. The distal end of the leg portion 58 of the vertical bar is formed into a general U-shape construction, allowing the front face 24 to be defined and the slot pairs 22 to be placed thereon.

The bracket unit 10 includes mounting means in the form of a rearwardly-positioned connector plate 62 having an opposed pair of mounting means in the form of flanges 64, 66, each of which includes a pair of hook portions 68 vertically spaced to allow engagement with one of the slots of adjacent slot pairs 22 on the vertical bars 20. Preferably, the hooks 68 are spaced such that the upper hook engages the lower slot of a first, upper slot pair 22, while the lower hook engages the upper slot of a second, lower slot pair. This allows the close vertical stacking of bracket units upon the vertical bars.

The connector plate 62 is further provided with a pair of horizontal ledges 70, 72 projecting forwardly from main vertical body portion 74. The ledges 70, 72 provide a means for attachment of wire elements which provide the mounting surfaces upon which the multi-pack product is placed. In particular, bottom ledge 72 supports the ends of first, U-shaped wire member 76 upon which the bottom surface of the packaging rests, while upper ledge 70 supports the ends of second wire package support element 78 which supports the bottom surface of the top panel of the packaging.

Figure 5:
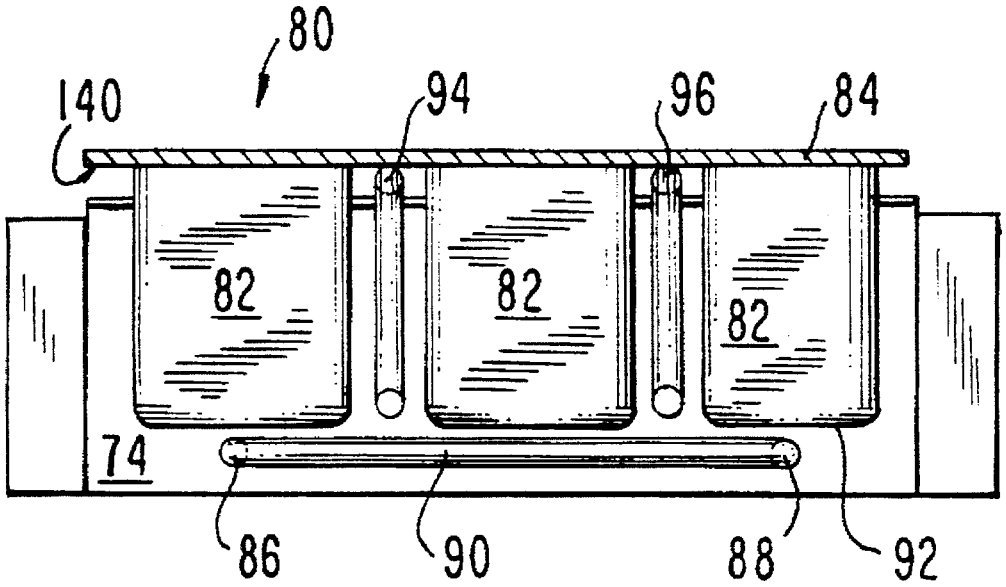
FIG. 5 is a front elevational view in section, taken along line 5—5 in FIG. 2.

As seen in FIG. 5, a first form of multi-pack packaging 80 typically comprises a plurality of individual containers 82 having a common planar cover panel. The legs 86, 88 of the first wire member 76, in cooperation with the crosspiece 90, support the bottom surfaces 92 of the outboard rows of containers 82, while the legs 140, 96 of the upper wire element 78 support the bottom surface 94 of the cover 84.

The forward ends of the legs 94 and 96 of upper member 78 form a pair of depending hook portions 96, joined by transverse portion 98. The transverse 98, which is located forwardly of the crosspiece 90 of the lower wire member 76, is adapted to support a flag 100, having a clip portion 102 formed at its top edge for engagement with the transverse. It is intended that informational indicia, such as product pricing, SKU number and the like, may be placed upon the flag for customer information and restocking purposes.

Figure 3:
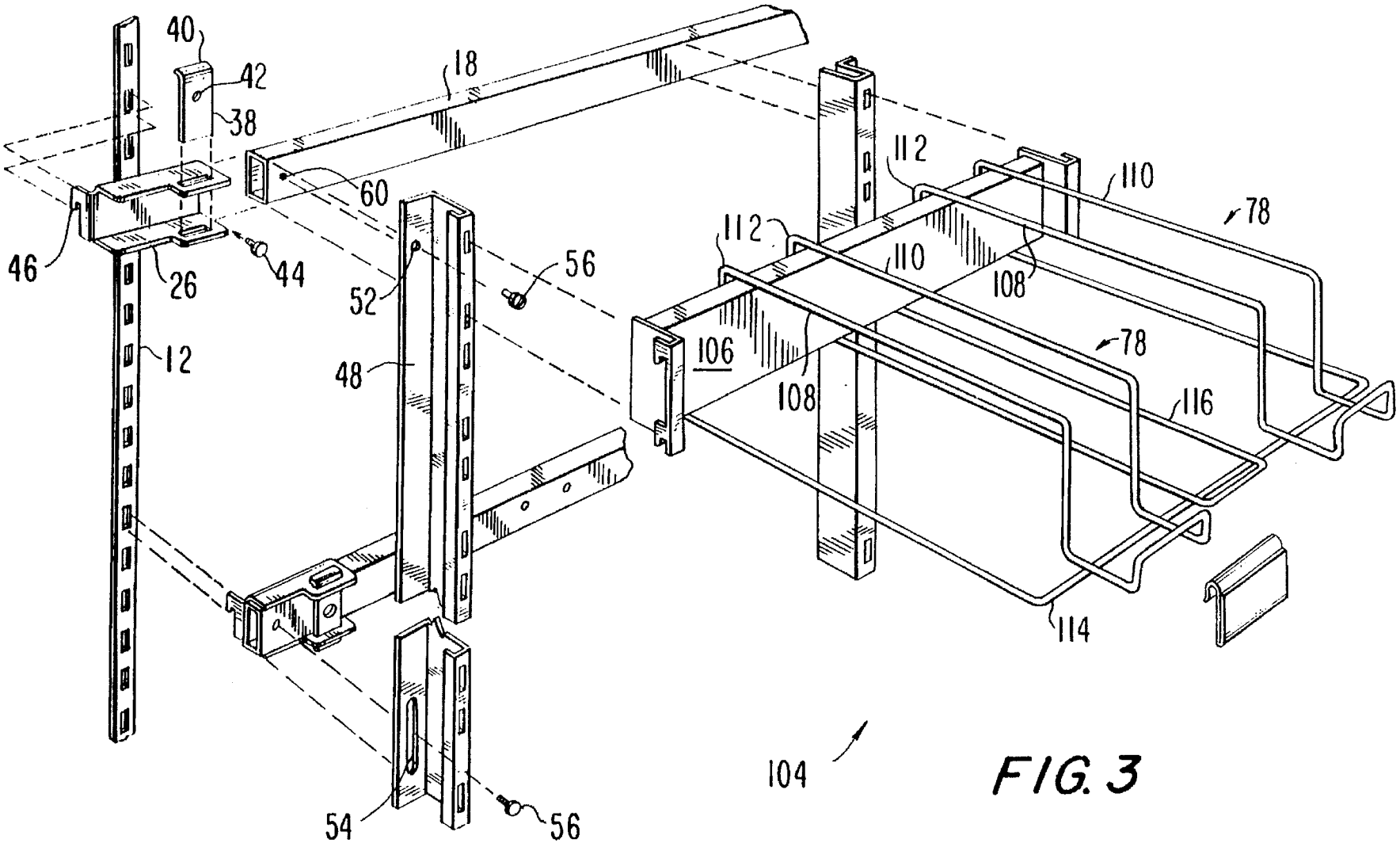
FIG. 3 is a front perspective view showing a second embodiment of the invention.

FIG. 3 depicts an alternative embodiment of the present invention in which the bracket unit 104 includes a tubular rear connector plate 106 having a rear wall to which a pair of upper, secondary support wire members 78 are mounted. In particular, the rearward ends of the rails 108, 110 may each be formed with a downwardly projecting portion 112 which is affixed to the rear face of the connector. The connector plate 106 is of extended length, allowing a plurality of wire members to be affixed thereto to support a desired plurality of multi-pack arrays. As shown in the figure, the bracket unit is adapted to support two such arrays in a side-by-side arrangement. Support for the bottom of the arrays is provided by a first U-shaped peripheral wire 114, affixed to the bottom surface of the connector plate 106, in conjunction with centrally located U-shaped support wire 116, similarly affixed to the lower edge of the connector plate. The central U-shaped wire member may project slightly beyond the front edge of the peripheral U-shaped wire 114 and optionally may be joined thereto at their points of intersection. It is to be recognized that the spacing between the adjacent legs of the peripheral and central U-shaped wires 114,116 are such that, they are defined as front and second wire pairs, they provide support for the outboard rows of containers in first and second side-by-side multi-packs in the manner analogous to the support of an individual multi-pack as depicted in FIG. 5.

It is to be appreciated that the construction of the bracket may be chosen to accommodate the width of the packaging, as well as the number and spacing of the individual containers 82.

Figure 4:
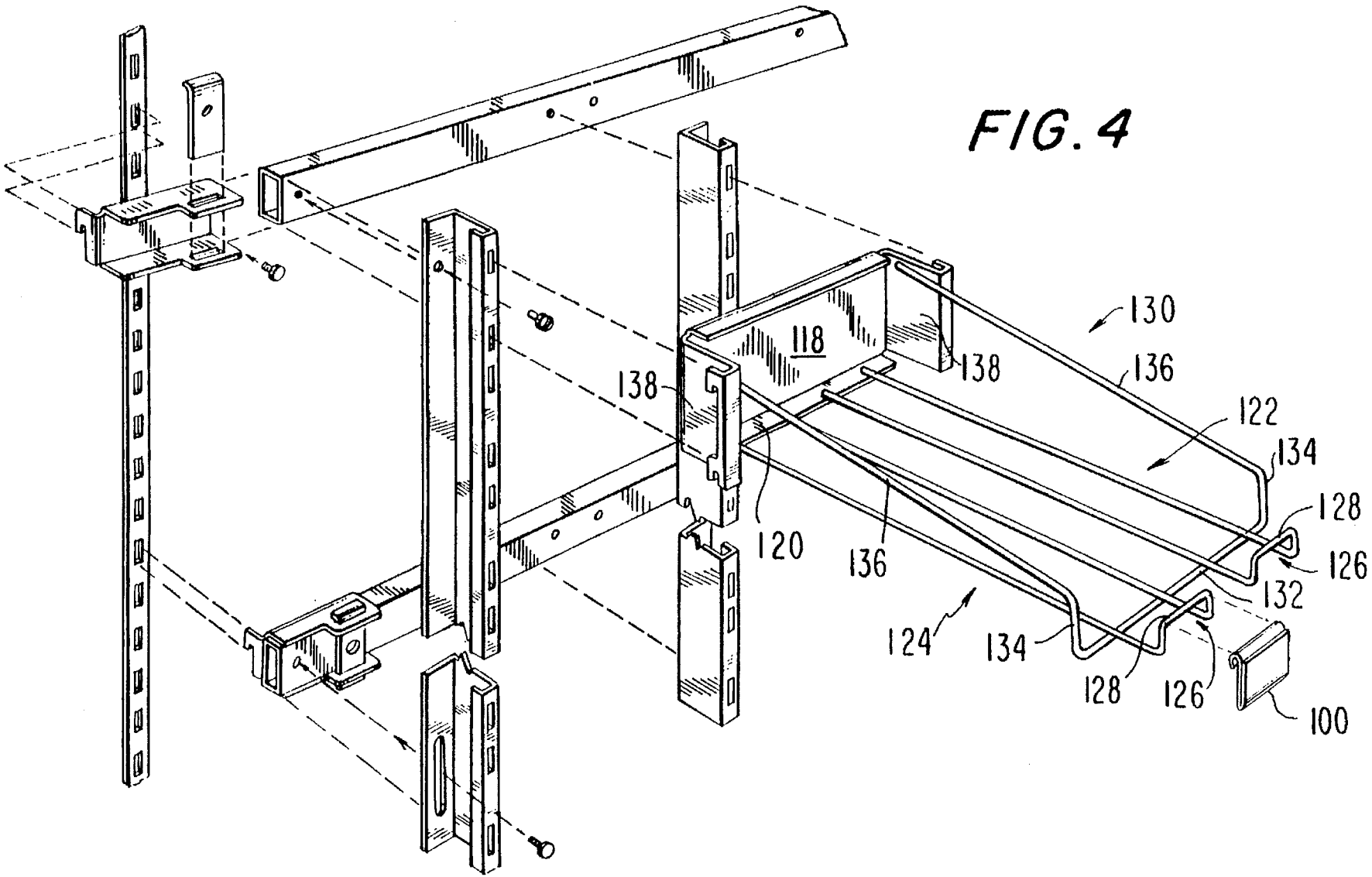
FIG. 4 is a front, exploded, perspective view showing a third embodiment of the invention.
Figure 6:
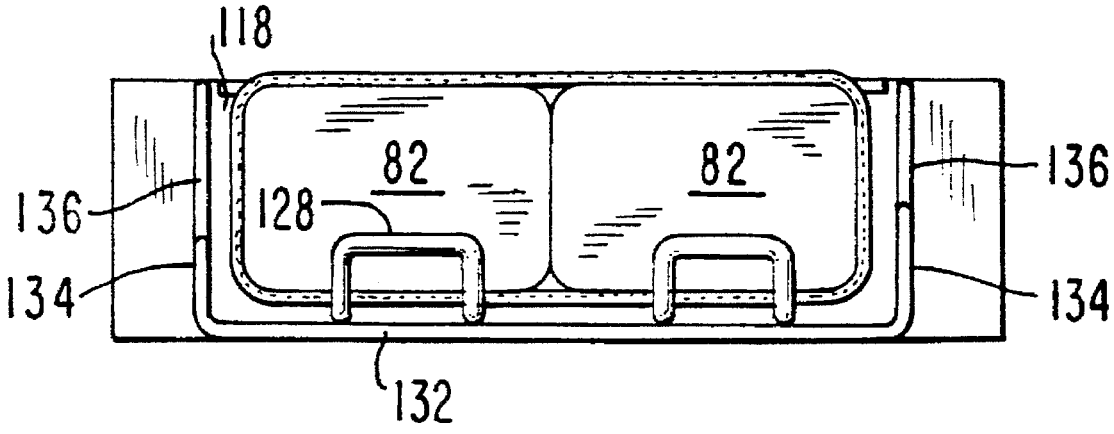
FIG. 6 is a front elevational view depicting the embodiment of FIG. 4.

FIGS. 4 and 6 present yet another embodiment of the present invention adapted for support and presentation of multi-pack products in overwrap packaging. As presented therein, the connector plate 118 includes a lower, forwardly-facing lip 120 to which a pair of U-shaped support wire units 122 and 124 are affixed. Each of the U-shaped wire support units may include an upwardly-turned front portion 126 having a transverse leg 128 upon which a flag or plate 100 may be hung. As best seen in FIG. 6, the parallel rails of each of the wire support units 122, 124 support the bottom of a row of the individual multi-pack containers 82. By supporting each row of containers along two parallel lines, stability is obtained without the need for the upper support wire as depicted in the other embodiments.

Because the overwrap prevents support of the product at the top cover panel, a pair of side frame elements is formed by a peripheral wire element 130, which includes a forwardly-located, horizontal transverse portion 132, positioned directly below an abutting against the U-shaped wire supports 122, 124. The transverse is coupled through riser elements 134 to the side rail or wall-defining portions 136. As shown, the side wall portions slope upwardly from the risers to the connector plate 118, and are affixed to the upper portion of the sides 138 thereof. Such construction provides a peripheral side support for the products. It can also be effectively used with multi-pack type products in which the individual containers are not joined by a common top panel, but are formed into an array solely by an overwrap.

It is to be further understood that the specific forms of the invention depicted herein are intended to be representative, as changes and modifications thereto may be made without departing from the invention. Reference is to be made to the annexed claims in determining the scope of the invention.

I claim:

1. Apparatus for the storage of multi-pack products having an array of individual containers joined together, comprising: a pair of spaced vertical mounting bars, a bracket element having a rear plate of a length to fit between the pair of spaced vertical mounting bars, first and second spaced forwardly-directed flanges each having a rear end mounted to said plate and projecting forwardly of the mounting bars to a front end of said flanges, hook means projecting rearwardly from the front end of said flanges for affixing the bracket element to the mounting bars; first support means extending forwardly from said rear plate for supporting each of the individual containers of a multi-pack product at a bottom thereof; and second support means extending forwardly from said rear plate parallel to said first support means and spaced therefrom for supporting a common top of said multipack product.

2. The apparatus of claim 1, wherein said first support means comprise at least one U-shaped wire having a pair of legs adapted and located to support the individual containers.

3. The apparatus of claim 1, wherein said second support means comprise a pair of parallel wire elements extending forwardly from said rear support means and positioned and located to engage a bottom surface of said common top.

4. The apparatus of claim 2, wherein said second support means comprise a pair of parallel wire elements extending forwardly from said rear support means and positioned and located to engage a bottom surface of said common top.

5. The apparatus of claim 4, wherein said pair of parallel wire elements comprise portions of a continuous piece of wire.

6. The apparatus of claim 5, wherein said continuous piece of wire includes a plate-mounting portion positioned forwardly of and between said parallel wire element portions.

7. The apparatus of claim 6, wherein said plate mounting portion depends from said parallel wire element portions.

8. The apparatus of claim 4, wherein said rear mounting means has top and bottom edges, said first support means being mounted to said bottom edge and said second support means being mounted to said top edge.

* * * * *